US005146955A

United States Patent [19]

Steiner et al.

[11] Patent Number: 5,146,955

[45] Date of Patent: Sep. 15, 1992

[54] FILLING THREAD DISTRIBUTOR MECHANISM FOR A SERIES-SHED WEAVING MACHINE

[75] Inventors: Alois Steiner, Rieden; Theodor Wuest; Marcel Christe, both of Ruti, all of Switzerland

[73] Assignee: Sulzer Brothers Limited, Winterthur, Switzerland

[21] Appl. No.: 609,892

[22] Filed: Nov. 6, 1990

[30] Foreign Application Priority Data

Nov. 16, 1989 [CH] Switzerland ..... 4130/89

[51] Int. Cl.[5] ..... D03D 47/30

[52] U.S. Cl. ..... 139/450; 139/11; 139/435.1; 139/435.3

[58] Field of Search ..... 139/450, 11, 453, 435.1, 139/435.3

[56] References Cited

U.S. PATENT DOCUMENTS 4,595,089 6/1986 Steiner ..... 139/188 R X
4,756,342 7/1988 Van Bogaert ..... 139/435.3
4,850,398 7/1989 Van Bogaert ..... 139/435.1

FOREIGN PATENT DOCUMENTS 0143860 6/1985 European Pat. Off. .
0225669 6/1987 European Pat. Off. .

*Primary Examiner*—Andrew M. Falik
*Attorney, Agent, or Firm*—Kenyon & Kenyon

[57] ABSTRACT

The filling thread distributor mechanism employs a stationary part having arcuate channels through which filling threads are continuously delivered. In addition, the mechanism has a rotatable part mounted on the weaving rotor which is provided with a plurality of circumferentially disposed transfer channels for sequential alignment with each connecting channel of the stationary part. Each transfer channel also communicates with a picking tube through which filling thread can be picked into a picking channels on the weaving rotor. A cutting mechanism is disposed between a picking tube and a picking channel in order to sever the filling thread and form a new tip for subsequent delivery to the next picking tube of the rotating part.

23 Claims, 3 Drawing Sheets

FILLING THREAD DISTRIBUTOR MECHANISM FOR A SERIES-SHED WEAVING MACHINE

This invention relates to a filling thread distributor mechanism for a series-shed weaving machine and particularly for a series-shed weaving machine employing air picking.

As is known, various types of filling thread distributor mechanisms have been employed for the picking of filling threads into a series-shed weaving machine. For example, European patent application 0142860 describes a system in which a filling thread is cut into segments for feeding into a series-shed weaving machine. However, in this case, the points of cut for the filling thread lie relatively far removed from the weaving rotor and discontinuous motions of transfer elements are necessary for the distribution of the filling threads.

Other types of distributor mechanisms have also been known from European Patent Applications 0143860 and 0225669. However, in each case, relatively complicated structures have been employed for the picking of the filling thread into the picking channels of a weaving rotor.

Accordingly, it is an object of the invention to provide a relatively simple construction for a filling thread distributor mechanism for a series-shed weaving machine.

It is another object of the invention to distribute filling thread into a series-shed weaving machine with low forces of acceleration in the distribution of the thread into the several picking channels of a weaving rotor.

It is another object of the invention to provide a relatively simple construction for picking filling threads into a plurality of picking channels of a series shed weaving machine rotor.

Briefly, the invention provides a filling thread distributor mechanism which is comprised of a stationary annular part having at least one channel in an end face, at least one feeder nozzle positioned in the stationary part for blowing a filling thread into the channel and a rotatable annular part coaxial of the stationary part for rotation with a weaving rotor of a series-shed weaving machine. In addition, the rotatable part has at least one picking tube for selective communication with the channel of the stationary part in order to receive a filling thread therefrom for passage to a picking channel on the weaving rotor.

The construction of the distributor mechanism is such that the two annular parts have a common axially symmetrical separating and sealing face through which the transfer of filling threads takes place.

One advantage of the distributor mechanism is that the distribution and reversal of picking threads are effected necessarily via closed channels, the formation of which takes place through the rotation of the weaving rotor.

In one embodiment, the stationary annular part is provided with a plurality of channels of arcuate contour, for example segments of a circle. In addition, the rotatably annular part is provided with a plurality of circumferentially spaced picking tubes arranged for sequential alignment with a respective channel so as to sequentially receive filling thread from the channel.

The construction of the distributor mechanism is such that a filling thread can be delivered through the channel of the stationary annular part and sequentially delivered through the picking tubes on the rotating part so that individual filling threads can be sequentially delivered to aligned picking channels on the weaving rotor. In this respect, a clamping and cutting mechanism is located between each respective picking channel and each respective picking tube of the rotatable annular part in order to sever a filling thread therein.

These and other objects and advantages of the invention will become more apparent from the following detailed description taken in conjunction with the accompanying drawings wherein:

FIG. 1 schematically illustrates a side view of a series-shed weaving machine constructed in accordance with the invention;

Figure 1:
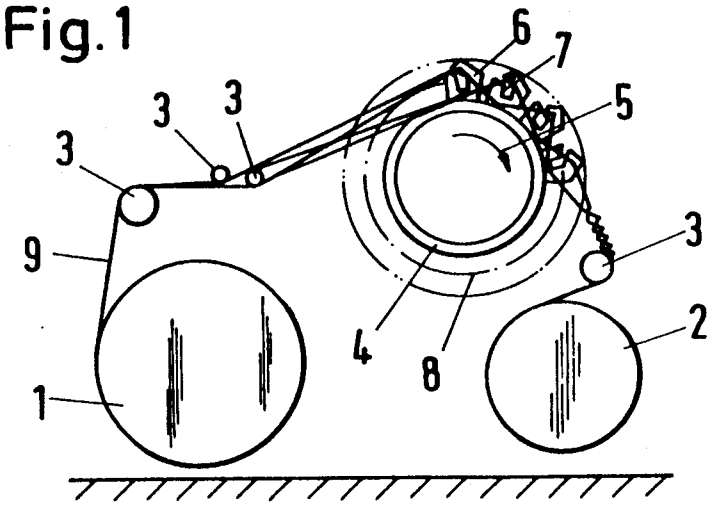

Referring to FIG. 1, the series-shed weaving machine is constructed for air picking. As indicated, the weaving machine includes a warp beam 1 from which a plurality of warp threads 9 are delivered via deflectors 3 tangentially to a rotating weaving rotor 4. The machine also includes a cloth beam 2 on which cloth is wound after being passed over a deflector 3. As indicated, the weaving rotor 4 has a plurality of combs 6 which are arranged in rows with respect to picking channels 7. The combs 6 serve to deflect the warp yarns within a certain range of deflection for the formation of sheds as is well known. During turning of the so-formed sheds in the direction indicated by the arrow 5, filling threads 10 (see FIG. 2) are picked and carried along by the combs 6 passing through the warp threads up to the tangential run-off of the newly formed fabric.

Figure 2:
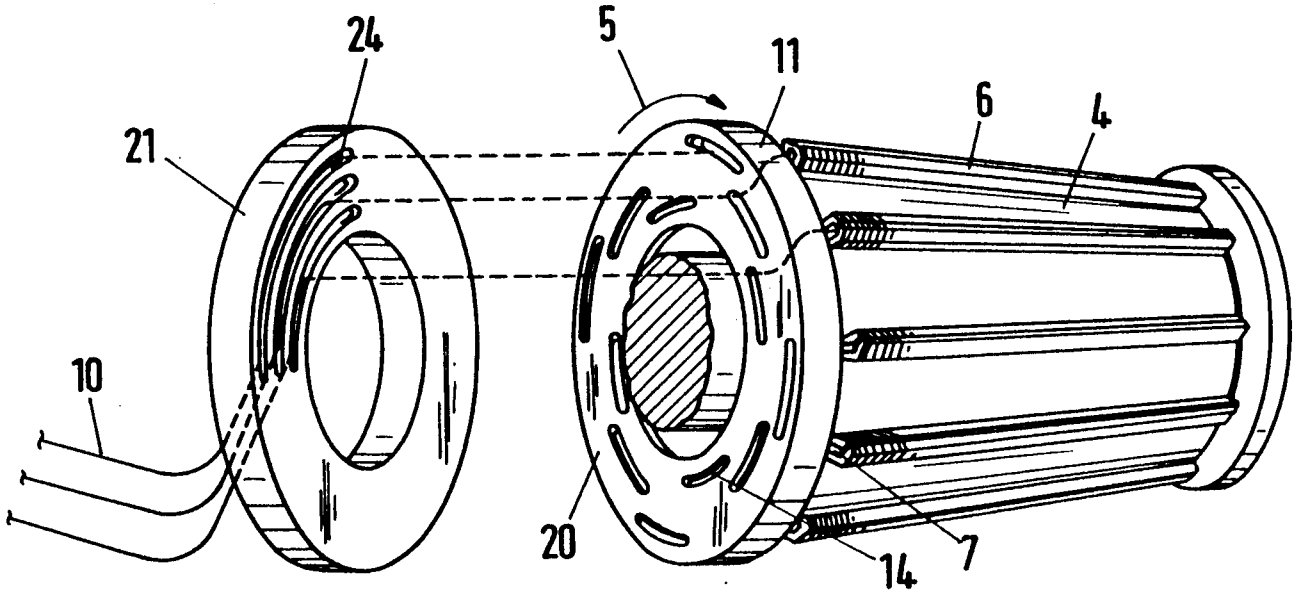
FIG. 2 illustrates an exploded view of a filling thread distributor mechanism constructed in accordance with the invention.

Referring to FIG. 2, a filling thread distributor mechanism is provided for the picking of the filling threads 10 into the respective picking channels 7. This mechanism is formed of a stationary annular part 21 having three arcuate connecting channels 24 in an end face thereof and a rotatable annular part 11 coaxial of the stationary part 21 and mounted on the rotor 4 for rotation therewith. As indicated, the rotatable part 11 has a plurality of arcuate transfer channels 14 for selective communication with the channels 24 of the stationary part 21 in order to receive the filling threads 10 for passage to the respective picking channels 7 on the rotor 4. These transfer channels 14 are arranged so that one set of circumferentially spaced transfer channels 14 is sequentially aligned with one channel 24 of the stationary part 21. As indicated, each set includes four transfer channels and there are three sets.

As indicated in FIG. 2, the parts 11, 21 have a common separating and sealing face 20 in an axially symmetrical plane through which the transfer of filling threads takes place.

Figure 3:
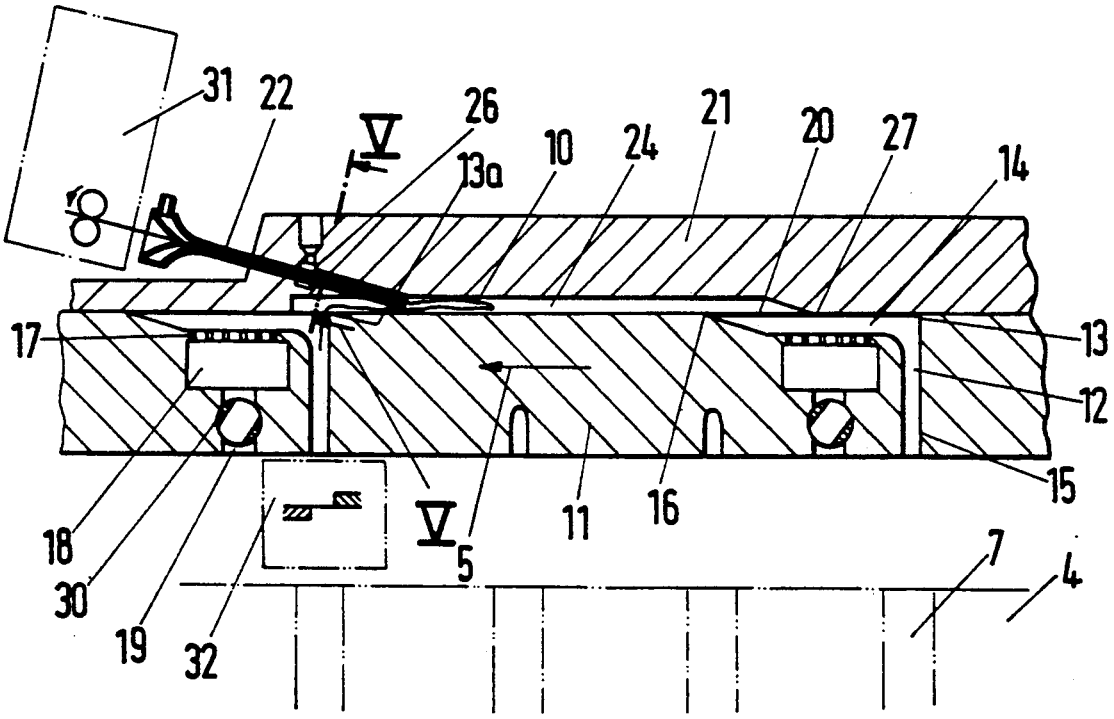
FIG. 3 illustrates a cross sectional view of a part of the distributor mechanism of FIG. 2.

Referring to FIG. 3, wherein like reference characters indicate like parts as above, a suitable thread feeder device 31 is provided for the continuous feeding of a filling thread 10 to the distributor mechanism for example at a speed which may be set at a fixed ratio to the rpm of the weaving rotor 4. In addition, a feeder nozzle 22 is mounted in the stationary part 21 of the distributor mechanism for blowing a filling thread 10 into the respective channel 24 of the annular part 21. As indicated, the feeding nozzle 22 is located at an upstream end of the connecting channel 24.

As indicated, the rotatable part 12 has a plurality of picking tubes 12 disposed on a common picking circle 8 (see FIG. 1) for the picking of the filling threads 10 into the respective picking channels 7 on the weaving rotor 4. Each picking tube 12 extends from one end of arcuately disposed transfer channel 14 in the face 20 of the rotatable part 11 to a mouth 15 disposed on an axis coincident with the axis of a picking channel 7. In addition, a stripping shoulder 13 is provided on the rotating part 11 at one end of the picking tube 12 in facing relation to the stationary part 21.

As indicated in FIG. 3, each transfer channel 14 extends from an opening edge 16 to the stripping shoulder 13 and is aligned with a connecting channel 24 such that during rotation of the rotatable part 11 in the direction indicated by the arrow 5, the opening edge 16 moves past a stationary edge 27 of the connecting channel 24. Thereafter, the connecting channel 24 in the stationary part 21 comes into communication with the transfer channel 14 so that air and a filling thread 10 can be blown through the channels 24, 14 into a picking tube 12 for transfer into a picking channel 7.

From each feeder nozzle 22, the filling thread 10 is blown cyclically into a certain number, $m=4$ of picking tubes associated with the nozzle 22. That is, the product of the number, $n=3$, of picking threads 10 fed by the thread feeder devices 31 and the number, $m=4$, of picking tubes 12 supplied with one of the filling threads 10 corresponds with the number of picking channels 7 on the weaving rotor 4, i.e. twelve picking channels.

Of note, the mouths 15 of the picking tubes 12 lie on the common picking circle 8 and are distributed uniformly for each feeder nozzle 22 while being offset from one feeder nozzle 22 to the next by one connecting channel pitch.

During the time of travel of the opening edge 16 of the transfer channel 14 away from the stationary edge 27 of the connecting channel 24 until the arrival of the stripping shoulder 13 at the edge 27, no gaps must occur in the picking of a newly formed tip of the filling thread. To this end, the transfer channels 14 of a given set are distributed uniformly along the circle common to the common connecting channel 24. In addition, the stripping shoulder 13 extends from the separating and sealing face 20 approximately at a right angle.

As indicated in FIG. 3, a cutting and clamping mechanism 32 is disposed between a picking tube 12 and a picking channel 7. This mechanism 32 serves to clamp and cut a filling thread being delivered into a picking channel 7 while at the same time forming a new tip on the continuously supplied filling thread 10.

Figure 5:
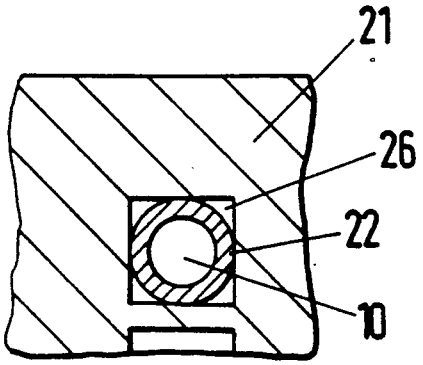
FIG. 5 illustrates a view taken on line V—V of FIG. 3.

The distributor mechanism is also provided with an auxiliary nozzle 26 for blowing air into the connecting channel 24 As indicated in FIGS. 3 and 5, the auxiliary nozzle 26 is disposed coaxially of the feeder nozzle 22 and has a square-shaped outlet while the feeder nozzle 22 has a circular shaped outlet within the contour of the square shaped outlet.

Referring to FIG. 3, during operation of the distributor mechanism, the preceding stripping shoulder 13*a* and the associated picking tube 12 are opened simultaneously with the succeeding picking tube 12 for a certain length of time to the connecting channel 24, as illustrated. Thus, the new tip of the filling thread 10 which at continuous delivery of the thread has arisen due to the cutting operation of the clamping and cutting mechanism 32, may be withdrawn from the picking tube 12 and picked via the succeeding picking tube 12 into another picking channel 7.

In order to achieve a reverse flow when withdrawing the newly formed tip of the filling thread and a nozzle action with the succeeding picking tube 12 for blowing the filling thread 10 into the next picking channel 12, the coaxially arranged nozzles 22, 26 blow air into the connecting channel 24 in a direction opposite to the direction of rotation of the rotatable part 11. As indicated, the direction of blow is at an acute angle to the center line of the connecting channel 24. The nozzles 22, 26 thus act as an injector which generates, on the one hand, via a mixing section, an overpressure in the region behind the nozzle mouth, relative to the direction of movement of the part 11, and, on the other hand, in the region before the nozzle mouth, a reduced pressure with respect to atmosphere.

In order to achieve this effect within a small compass, the use of a square outlet on the auxiliary nozzle 26 has proved to be advantageous.

If the thread feeder device 31 delivers the filling thread 10 at a speed greater than the circumferential speed at the picking circle, a loop of thread arises in the connecting channel 24 (as shown) and is directed towards the next picking tube 12 as long as the filling thread becomes clamped and cut at the outlet from the preceding picking tube 12. After the cutting and release of the new tip of the filling thread, the thread is straightened out within the connecting channel 24.

Figure 4:
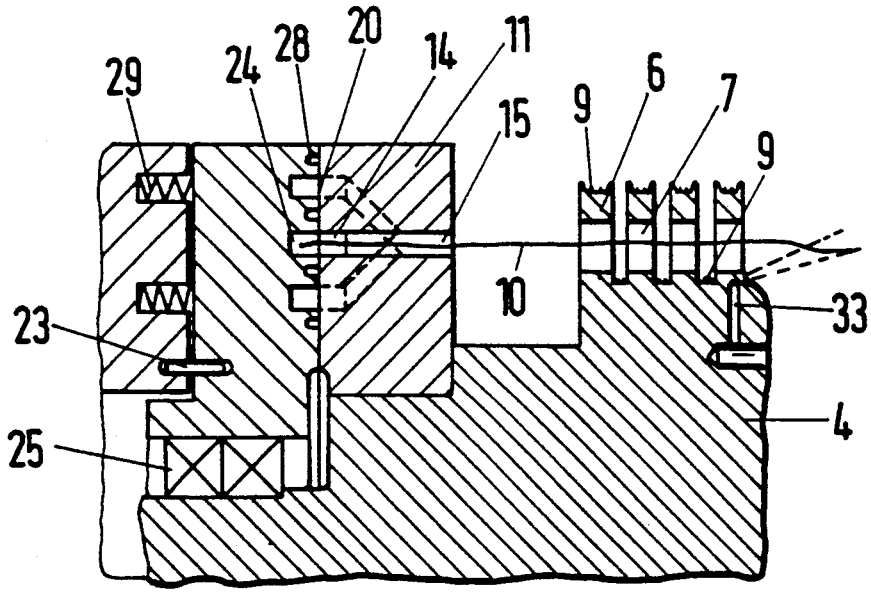
FIG. 4 illustrates a further part cross-sectional view of the distributor mechanism of FIG. 2 mounted on a series-shed weaving rotor in accordance with the invention.

Referring to FIG. 4, relay nozzles 33 are provided on the weaving rotor 4 along the picking channels 7 in order to assist the pick from the picking tubes 12. Cutting of a filling thread may be performed by a stationary tool into which the filling threads 10 necessarily run with the turning motion of the mouth 15 and the picking channel 7. In order to utilize the injector effect at the connection position of the guide channels 12, 24, 14, the filling thread 10 being picked must, at predetermined positions of rotation with respect to the stationary part 21, e.g. to the feeder and auxiliary nozzles 22, 26, be clamped, cut and released as the new tip of the filling thread. The magnitude and the length of time of the pulses of air flow from the feeder nozzle 22 and/or the auxiliary nozzle 26 is likewise controlled in dependence upon the position of rotation of the associated filling thread 10.

During picking of the filling thread 10 into a picking channel 7, the air flow in the guide channels 24, 14, 12 and the air flow from the relay nozzles 33 generates a pull on the filling thread which makes the thread rest against the inner diameter of the segments of circular arc of the connecting channel 24 and the transfer channel 14. By undercutting these inner faces, the filling thread 10 is displaced more towards the bottom of the channel and away from the separating and sealing face 20.

In order to further assist in the reversal of air flow from one picking tube 12 to the next picking tube 12, at least one blow off opening 17 is provided in the rotatable part 11 or the stationary part 21 in the vicinity of the transfer channel 14. For example, the blow off opening 17 may be provided in the rotatable part 11 adjacent to the picking tube 12 in order to vent air from the transfer channel 14. As indicated, the blow off opening 17 extends from the transfer channel 14 at an angle of at least 90° relative to the direction of rotation of the rotatable part 11. Further, the blow off opening 17 has a width of less than 1.5 millimeters in the direction of rotation of the rotating part 11.

The more abrupt the branching off and the less the width of the blow off opening 17 in the direction of rotation, the lower is the risk of the filling thread catching. Since the action of the blow off opening 17 is required, above all, during the reversal of the air flow, a collecting or buffer chamber 18 is disposed in the rotating part 11 in communication with the opening 17 along with a discharge opening 19 which extends from the buffer chamber 18 to the outside environment. In addition, an adjustable throttle 30 is disposed in the discharge opening 19 in order to adjust the outflow resistance in the discharge opening 19. In this respect, the outflow may be completely closed over a certain angle of rotation of the picking tube 12 with respect to the stationary part 21.

In order to avoid too great a loss of air and catching of the filling thread 10 in the separating and sealing face 20, various measures are possible. First of all, the distance above the face of the stationary part 21 from the face of the rotating part 11 may be limited to a distance of 0.2 millimeters or less. Alternatively, the parts may be slidably mounted on each other with the sliding faces made of suitable materials for sliding on one another. In addition, means may be provided for adjusting the contact pressure of one face against another. This presupposes a wear resistant pairing of the materials with good dry-running properties. Also, means may be provided for feeding lubricant between the parts 11, 21. A further measure consists in fitting sealing strips adjacent the channels 14, 24 so as to maintain the parts 11, 21 in sealed relation. Also, means may be provided for venting the space between the two parts 11, 21.

The distributor mechanism may be utilized for picking filling threads 10 from both sides of a weaving rotor 4. In this case, correspondingly more picking channels 7 which form sheds must be present and both mechanisms must be offset by one picking channel pitch. Also, the relay nozzles of both system must be directed in opposite directions.

Referring to FIG. 4, the rotating part 11 of the distributor mechanism may be mounted directly on the rotor 4 while the stationary part 21 is mounted via a bearing 25 on the rotor 4. In addition, the stationary part may be provided with means such as pins 23 to prevent turning of the part 21 in a machine frame. In addition, means in the form of springs 29 may be provided between the stationary part 21 and the frame in order to bias the parts 21, 11 together under an adjustable contact pressure.

As indicated, seal means 28 may be provided between the parts 11, 21 for sealing the parts together as shown in FIG. 4, the seal means 28 may be in the form of sealing strips adjacent the channels 24.

Referring to FIG. 3, during operation, a filling thread is injected via the feeder nozzle 22 and to the connecting channel 24. Initially, the tip of the filling thread 10 passes into the transfer channel 14 and is then conveyed through a picking tube 12 into a picking channel 7 aligned therewith during rotation of the rotating part 11. During continued rotation, the transfer channel 14 moves into a position as indicated in FIG. 3 and the filling thread passing between the picking channel 12 and the picking tube 12 is cut by the cutting and clamping mechanism 32. The new tip of the thread is then withdrawn through the picking tube 12 while a loop of thread forms within the connecting channel 24 as is shown in FIG. 3. During this time, the next transfer channel 14 passes into alignment with the connecting chamber 24 so that the loop of thread can be drawn out and the fresh tip directed into the second picking tube 12 for picking into the next picking channel 7. This operation continues in a cyclical manner so that the filling thread is sequentially delivered into each picking tube 12 associated with a given connecting channel 24.

The invention thus provides a relatively simple filling thread distributor mechanism which can be readily mounted on a weaving rotor of a series-shed weaving machine.

Further, the invention provides a distributor mechanism which can readily direct filling thread into the picking channels of a weaving rotor of a series shed machine in a simple manner.

Still further, the invention provides a filling thread distributor mechanism which is able to cut and deliver filling threads into picking channels in a sequential manner with little time delay from a point of delivery.

What is claimed is:

1. A filling thread distributor mechanism comprising:
   a stationary annular part having at least one channel in an end face thereof;
   at least one feeder nozzle positioned in said stationary part for continuously blowing a filling thread into said channel; and
   a rotatable annular part coaxial of said stationary part for rotation with a weaving rotor of series-shed weaving machine, said rotatable part having a plurality of circumferentially spaced picking tubes for selective communication with said channel of said stationary part, each of said tubes being sequentially aligned with said channel of said stationary part for receiving a filling thread therefrom for passage to a picking channel on the weaving rotor, wherein said channel of said stationary part extends along a segment of circular arc and faces said rotatable part.

2. A mechanism as set forth in claim 1 wherein said stationary part has a plurality of said channels therein and said rotating part has a plurality of circumferentially spaced picking tubes for sequential alignment with each respective channel.

3. A mechanism as set forth in claim 1 wherein said rotatable part has a stripping shoulder at one end of said picking tube in facing relation to said stationary part and said tube has a mouth on an axis coincident with an axis of a picking channel.

4. A mechanism as set forth in claim 1 wherein said feeder nozzle is angularly directed into said channel to blow air into said channel in a direction opposite to the direction of rotation of said rotatable part.

5. A mechanism as set forth in claim 4 which further comprises an auxiliary nozzle for blowing air into said channel, said auxiliary nozzle being disposed coaxially of said feeder nozzle.

6. A mechanism as set forth in claim 5 wherein said auxiliary nozzle has a square-shaped outlet and said feeder nozzle has a circular shaped outlet within the contour of said square shaped outlet.

7. A mechanism as set forth in claim 1 further comprising at least one blow-off opening in at least one of said parts adjacent a respective picking tube for venting air from said channel.

8. A mechanism as set forth in claim 7 wherein said blow-off opening extends from said channel at an angle of at least 90 degrees relative to the direction of rotation of said rotatable part.

9. A mechanism as set forth in claim 8 wherein said blow-off opening has a width of less than 1.5 millimeters in the direction of rotation of said rotating part.

10. A mechanism as set forth in claim 7 which further comprises a buffer chamber in said one part in communication with said blow-off opening, a discharge opening communicating with said buffer chamber and an adjustable throttle in said discharge opening.

11. A mechanism as set forth in claim 10 wherein said rotatable part has a transfer channel in a face thereof facing said stationary part and in communication with said picking tube, said transfer channel being positioned to close off said discharge opening in a predetermined angular position of said transfer channel relative to said channel of said stationary part.

12. A mechanism as set forth in claim 1 wherein said parts are spaced apart a distance of 0.2 millimeters.

13. A mechanism as set forth in claim 1 wherein said parts are slidably mounted on each other.

14. A mechanism as set forth in claim 1 which further comprises sealing strips adjacent said channel and in sealed relation between said parts.

15. In combination, a weaving rotor for a series-shed weaving machine having a plurality of circumferentially spaced picking channels thereon; and a filling thread distributor mechanism at at least one end of said rotor for inserting filling thread into said channels, said mechanism including a stationary annular part having at least one channel in a face thereof, a feeder nozzle for blowing filling thread into said channel, and a rotatable annular part mounted on said rotor for rotation therewith and having a plurality of circumferentially spaced picking tubes for selective communication with said channel of said stationary part to receive a filling thread for passage to an aligned picking channel.

16. The combination as set forth in claim 15 which further comprises a thread feeder device for continuously feeding thread to said feeding nozzle.

17. The combination as set forth in claim 15 which further comprises a bearing journalling said rotor in said stationary part.

18. The combination as set forth in claim 15 wherein said stationary part has a plurality of said channels therein and said rotating part has a plurality of circumferentially spaced picking tubes for sequential alignment with each respective channel.

19. The combination as set forth in claim 15 which further comprises a clamping and cutting mechanism between a respective picking channel and a respective picking tube for severing a filling thread thereat.

20. The combination as set forth in claim 19 wherein said feeder nozzle is angularly directed into said channel to blow air into said channel in a direction opposite to the direction of rotation of said rotatable part to direct a freshly cut filling thread into said channel of said stationary part for subsequent delivery to a successive picking channel.

21. The combination as set forth in claim 15 wherein said channel in said stationary part has undercuts directed away from said rotatable part.

22. The combination as set forth in claim 15 which further comprises means for biasing said parts together under an adjustable contact pressure.

23. The combination as set forth in claim 15 which further comprises a second distributor mechanism at an opposite end of said rotor for introducing filling threads into picking channels offset from one another.

* * * * *

UNITED STATES PATENT AND TRADEMARK OFFICE

CERTIFICATE OF CORRECTION

PATENT NO. : 5,146,955

DATED : September 15, 1992

INVENTOR(S) : Steiner et al.

It is certified that error appears in the above-identified patent and that said Letters Patent is hereby corrected as shown below:

Column 1, line 62, change "rotatably" to --rotatable--;

Column 3, line 6, change "12" to --11--;

Column 4, line 53, change "generates" to --generate--;

Column 5, line 43, change "system" to --systems--.

Signed and Sealed this

First Day of March, 1994

*Attest:*

*Attesting Officer*

BRUCE LEHMAN

*Commissioner of Patents and Trademarks*